US008465602B2

(12) United States Patent
Shmyreva et al.

(10) Patent No.: US 8,465,602 B2
(45) Date of Patent: Jun. 18, 2013

(54) AMORPHOUS-NANOCRYSTALLINE-MICROCRYSTALLINE COATINGS AND METHODS OF PRODUCTION THEREOF

(75) Inventors: Tetyana P. Shmyreva, Indianapolis, IN (US); James Knapp, Pittsboro, IN (US); Ardy Simon Kleyman, Carmel, IN (US)

(73) Assignee: Praxair S. T. Technology, Inc., North Haven, CT (US)

( * ) Notice: Subject to any disclaimer, the term of this patent is extended or adjusted under 35 U.S.C. 154(b) by 1562 days.

(21) Appl. No.: 11/942,212

(22) Filed: Nov. 19, 2007

(65) Prior Publication Data

US 2012/0171469 A1 Jul. 5, 2012

Related U.S. Application Data

(60) Provisional application No. 60/981,550, filed on Oct. 22, 2007, provisional application No. 60/875,069, filed on Dec. 15, 2006.

(51) Int. Cl.
*C22C 45/00* (2006.01)
*C22C 29/12* (2006.01)

(52) U.S. Cl.
USPC ..... 148/403; 75/240; 75/252; 75/255

(58) Field of Classification Search
None
See application file for complete search history.

(56) References Cited

U.S. PATENT DOCUMENTS 2,714,563 A 8/1955 Poorman et al.
3,986,867 A 10/1976 Masumoto et al.
4,144,058 A 3/1979 Chen et al.
4,519,840 A 5/1985 Jackson et al.
4,626,476 A 12/1986 Londry et al.
4,668,310 A 5/1987 Kudo et al.
4,902,539 A 2/1990 Jackson
4,999,255 A 3/1991 Jackson et al.
5,055,144 A * 10/1991 Fish et al. ..... 148/509
5,075,129 A 12/1991 Jackson et al.
5,316,859 A 5/1994 Harada et al.

(Continued)

FOREIGN PATENT DOCUMENTS

WO WO 2006/034054 A1 3/2006

OTHER PUBLICATIONS

Otsubo, F. et al., "Formation of Amorphous Fe-Cr-Mo-8P-2C Coatings by the High Velocity Oxy-Fuel Process", Journal of Thermal Spray Technology, vol. 9(4), Dec. 2000, pp. 494-498, XP002523379.

(Continued)

*Primary Examiner* — George Wyszomierski
(74) *Attorney, Agent, or Firm* — Nilay S. Dalal

(57) ABSTRACT

This invention relates to thermally sprayed coatings having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating. This invention also relates to methods for producing the coatings, thermal spray processes for producing the coatings, and articles coated with the coatings. The thermally sprayed coatings of this invention provide enhanced wear and corrosion resistance for articles used in severe environments (e.g., landing gears, airframes, ball valves, gate valves (gates and seats), pot rolls, and work rolls for paper processing).

9 Claims, 5 Drawing Sheets

U.S. PATENT DOCUMENTS

| | | | | |
|---|---|---|---|---|
| 5,741,556 | A | 4/1998 | Taylor et al. | |
| 5,985,373 | A | 11/1999 | Chernyshov | |
| 6,000,627 | A | 12/1999 | Chernyshov | |
| 6,146,693 | A | 11/2000 | Chernyshov et al. | |
| 6,168,828 | B1 | 1/2001 | Chernyshov et al. | |
| 6,212,988 | B1 | 4/2001 | Chernyshov et al. | |
| 6,258,417 | B1 | 7/2001 | Goswami et al. | |
| 6,398,124 | B1 | 6/2002 | Barykin et al. | |
| 6,503,290 | B1 | 1/2003 | Jarosinski et al. | |
| 6,503,575 | B1 | 1/2003 | Payne et al. | |
| 6,517,010 | B1 | 2/2003 | Barykin et al. | |
| 6,579,573 | B2 | 6/2003 | Strutt et al. | |
| 6,745,951 | B2 | 6/2004 | Barykin et al. | |
| 7,208,097 | B2 * | 4/2007 | Kanekiyo et al. | 252/62.53 |
| 7,771,798 | B1 * | 8/2010 | Grosse et al. | 427/569 |
| 2001/0022208 | A1 | 9/2001 | Perepezko et al. | |
| 2005/0263216 | A1 * | 12/2005 | Chin et al. | 148/304 |

OTHER PUBLICATIONS

Stewart D.A. et al., "Microstructural Evolution in Thermally Sprayed WC-Co Coatings: Comparison Between Nanocomposite and Conventional Starting Powders", ACTA Materialia, vol. 48, (2000), pp. 1593-1604, XP002523376.

Verdon C. et al., "A Study of High Veocity Oxy-ful Thermally Sprayed Tungsten Carbide Based Coatings. Part 1: Microstructures", Materials Science and Engineering, vol. A246, (1998), pp. 11-24, XP002523377.

* cited by examiner

AMORPHOUS-NANOCRYSTALLINE-MICROCRYSTALLINE COATINGS AND METHODS OF PRODUCTION THEREOF

RELATED APPLICATIONS

This application claims the benefit of U.S. Provisional Application Ser. No. 60/981,550, filed on Oct. 22, 2007, and U.S. Provisional Application Ser. No. 60/875,069, filed on Dec. 15, 2006, both of which are incorporated herein by reference.

FIELD OF THE INVENTION

The invention relates to thermally sprayed coatings having an amorphous-nanocrystalline-microcrystalline composition structure, methods of producing said coatings, thermal spray processes for producing said coatings, and articles coated with said coatings.

BACKGROUND OF THE INVENTION

Materials having an amorphous structure are known to exhibit high corrosion resistance. Nanocrystalline materials (materials having a grain size below 100 nanometers) are known to be very hard but typically brittle. Microcrystalline materials (materials with grain size below 1000 nanometers) are known to have intermediate corrosion and mechanical properties between amorphous and nanocrystalline materials, but have higher thermal stability than metastable nanocrystalline and amorphous phases.

Research in the fields of nanostructured and amorphous materials has focused on synthesis and processing of bulk amorphous and nanocrystalline alloys. A number of international conferences conduct special sessions directed to these materials including bulk metallic glasses, bulk nanocrystalline materials, ultrafine grained materials, and nanostructured coatings. These materials are generally developed at request of militaries and other industries, but most of the work is still in the research stage.

A development challenge is that nanocrystalline amorphous materials with the most technologically attractive properties have melting temperatures above 1700° F., for example, W, Fe, Ni, Co, Cr and other metal-based alloys. It is a technical challenge to obtain nanocrystalline amorphous structure in materials with such high melting temperature. It can be done if the alloy is solidified from molten phase with very high rate, e.g., above about 100,000 Kelvin degree per second (>$10^5$ K/s), but this results in the very thin films/foils (below 1-2 mils thick). Such thin layers without bonding to a part surface are useless for practical application.

Numerous industries require materials and coatings with enhanced wear and corrosion resistance for severe environments. Thermal spray coating processes are leading technologies for obtaining high quality coatings in terms of high adhesion to the substrate, density, and homogeneity. The coatings/materials that combine high corrosion resistance and enhanced mechanical properties such as hardness and wear resistance can solve significant technical and economical problems in metallurgy, paper industry, medicine, oil transportation and other fields.

There continues to be a need in the art to provide improved materials and coatings with enhanced wear and corrosion resistance for severe environments such as for landing gears, airframes, ball valves, gate valves (gates and seats), pot rolls, work rolls for paper processing, and the like.

SUMMARY OF THE INVENTION

This invention relates in part to thermally sprayed coatings having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating.

This invention also relates in part to a method of producing a thermally sprayed coating having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating; wherein said method comprises: (i) providing a thermal spray apparatus capable of generating a high velocity gas jet; (ii) providing a substrate to be impinged by said gas jet; (iii) generating said high velocity gas jet in which said thermal spray apparatus is operating at an equivalence ratio (ratio of the actual fuel/air ratio to the stoichiometric fuel/air ratio) of from about 1 to about 3 and a firing frequency of from about 5 to about 200 Hz; and (iv) introducing into said gas jet a coating powder material not having an amorphous-nanocrystalline-microcrystalline composition structure; wherein said substrate is positioned at a distance from said thermal spray apparatus whereby said coating powder material impinges said substrate at a temperature and velocity effective to induce transformation of at least a portion of said coating powder material to said coating having an amorphous-nanocrystalline-microcrystalline composition structure.

This invention further relates in part to a thermal spray process comprising thermally depositing a coating powder material, said coating powder material not having an amorphous-nanocrystalline-microcrystalline composition structure, onto a substrate under thermal spray conditions sufficient to produce a coating having an amorphous-nanocrystalline-microcrystalline composition structure, said coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating.

This invention yet further relates in part to an article coated with a thermally sprayed coating, said thermally sprayed coating having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating.

The thermally sprayed coatings of this invention having an amorphous-nanocrystalline-microcrystalline composition structure provide enhanced wear and corrosion resistance for articles used in severe environments such as for landing gears, airframes, ball valves, gate valves (gates and seats), pot rolls, work rolls for paper processing, and the like.

DETAILED DESCRIPTION OF THE INVENTION

Figure 1:
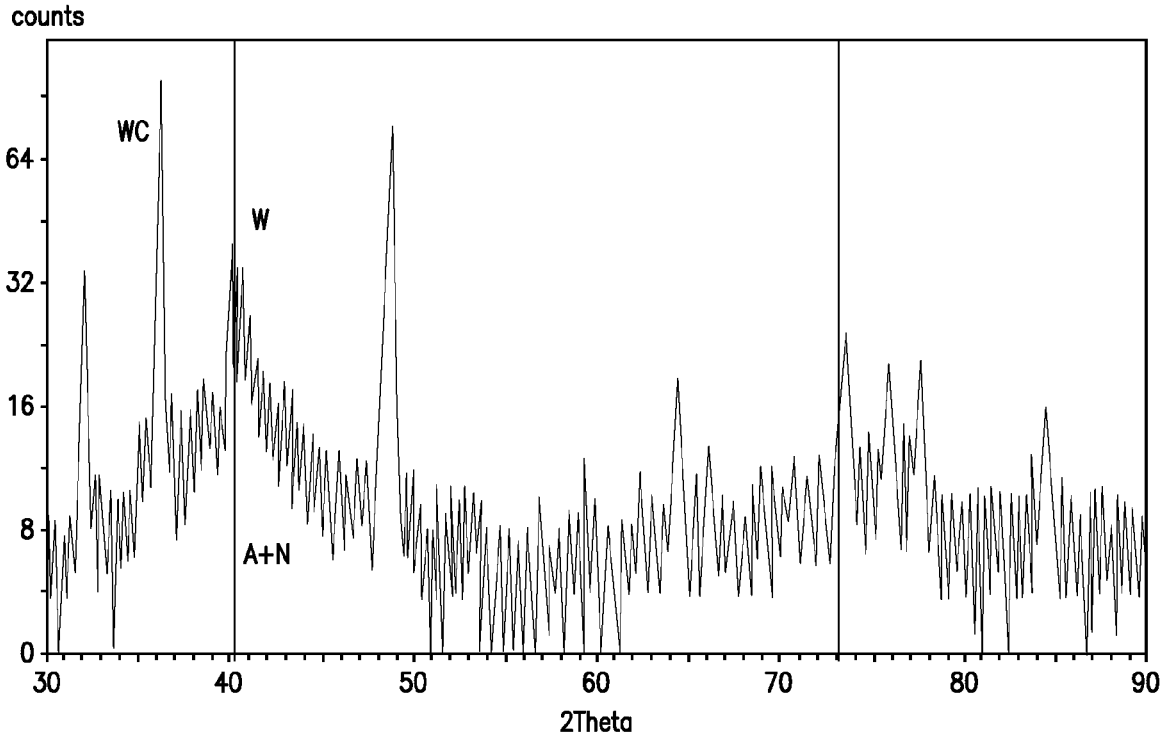
FIG. 1 is an X-ray diffraction pattern of a bulk amorphous-nanocrystalline-microcrystalline coating from a WC—Co-based composition (A-amorphous and N-nanocrystalline tungsten(W) based phases and microcrystalline tungsten carbide (WC maximums marked with green lines)).
Figure 2A:
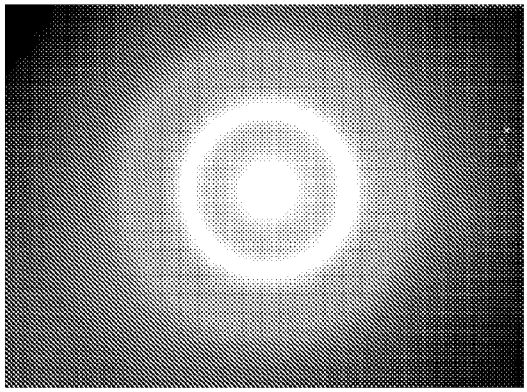
FIG. 2 are transmission electron microscopy micro-diffractions (a, b) and images of WC—Co coating microstructure at 60,000× (c, d). Micro-diffraction a) has a halo from an amorphous matrix. Micro-diffraction b) has diffraction rings and individual reflexes from the nanocystalline-microcrystalline phases. Image c) is a bright field image of an amorphous matrix with incorporated nanocrystalline-microcrystalline size grains of crystals. Image d) is a nanocrystalline area bright field image.
Figure 2B:
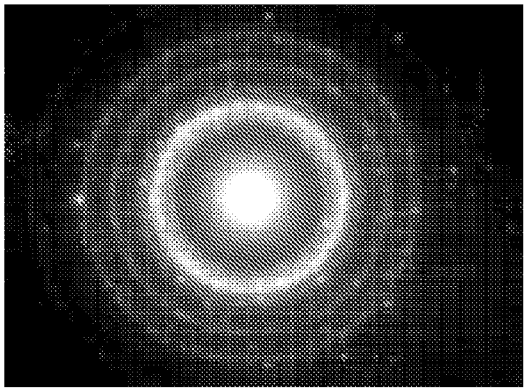
Figure 2C:
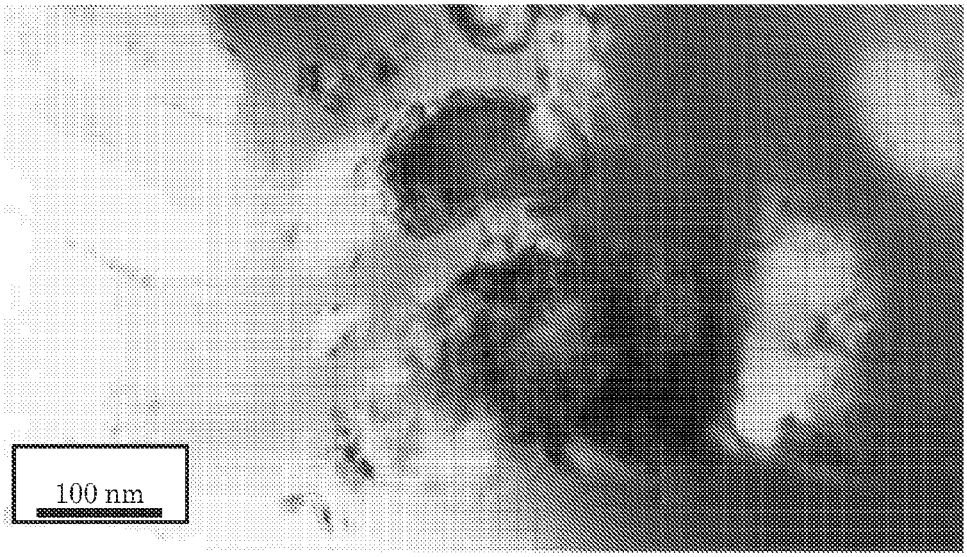
Figure 2D:
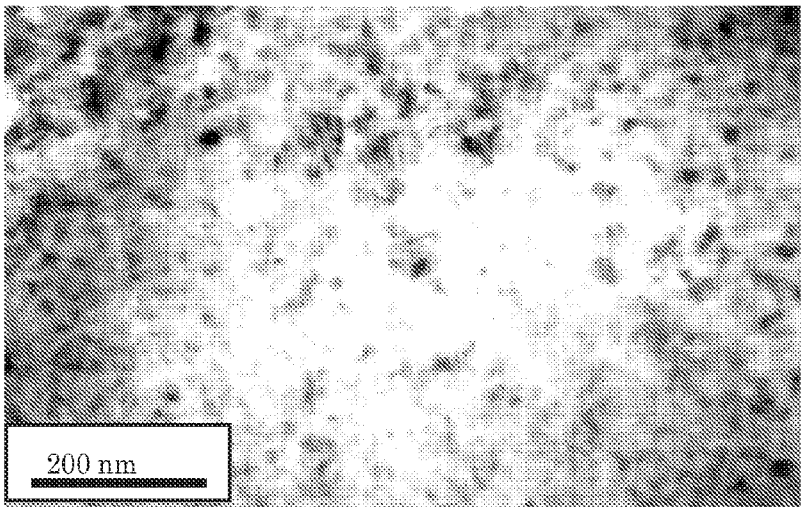

As indicated above, this invention relates in part to thermally sprayed coatings having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating.

The thermally sprayed coatings of this invention allow accumulating into one coating the best properties of three structures, i.e., amorphous, nanocrystalline and microcrystalline structures. In accordance with this invention, it is important to have not only the amorphous and nanocrystalline phases, but also the microcrystalline phase, because the microcrystalline phase is more thermally stable than the amorphous and nanocrystalline phases and the microcrystalline phase can provide better hardness-elasticity than the nanocrystalline phase.

The thermally sprayed coatings having an amorphous-nanocrystalline-microcrystalline composition structure exhibit enhanced wear resistance, corrosion resistance and thermal stability. As demonstrated in the examples below, the thermally sprayed coatings having an amorphous-nanocrystalline-microcrystalline composition structure have higher wear and corrosion resistance than conventional coatings.

The nanocrystalline phase is made up of discrete particles, wherein said particles comprise one or more grains having a nanocrystalline structure, and wherein said nanocrystalline structure comprises a grain size of less than about 100 nanometers. The microcrystalline phase is likewise made up of discrete particles, wherein said particles comprise one or more grains having a microcrystalline structure, and wherein said microcrystalline structure comprises a grain size of from about 100 nanometers to less than about 1000 nanometers. The nanocrystalline phase particles and the microcrystalline phase particles are typically dispersed in the amorphous phase.

In the thermally sprayed coatings of this invention, the distance between the nanocrystalline phase particles is typically no greater than about 0.5 mils, preferably no greater than about 0.4 mils. The distance between the microcrystalline phase particles is likewise no greater than about 0.5 mils, preferably no greater than about 0.4 mils. The distance between the nanocrystalline phase particles and the microcrystalline phase particles in the thermally sprayed coatings of this invention is no greater than about 0.5 mils, preferably no greater than about 0.4 mils. In general, when the distance between the nanocrystalline phase particles, or the distance between the microcrystalline phase particles, or the distance between the nanocrystalline phase particles and the microcrystalline phase particles, exceeds 0.5 mils, their density is not sufficient to achieve the hardening effect from the precipitants.

The thermally sprayed coatings of this invention typically comprise from about 5 to about 90 volume percent of said amorphous phase, preferably from about 10 to about 80 volume percent of said amorphous phase, and more preferably from about 25 to about 75 volume percent of said amorphous phase. The amorphous phase can be doped with oxygen in an amount below about 0.2% in the form of oxide layers having nanocrystalline-microcrystalline thickness and periodically distributed in the coating. The oxide phase is the result of a thermo-chemical reaction between oxygen from detonating gases and metal in the coating powder.

The thermally sprayed coatings of this invention typically comprise from about 5 to about 75 volume percent of said nanocrystalline phase, preferably from about 10 to about 60 volume percent of said nanocrystalline phase, and more preferably from about 25 to about 50 volume percent of said nanocrystalline phase.

The thermally sprayed coatings of this invention typically comprise from about 5 to about 80 volume percent of said microcrystalline phase, preferably from about 10 to about 70 volume percent of said microcrystalline phase, and more preferably from about 25 to about 50 volume percent of said microcrystalline phase. It is important to have not only the amorphous and nanocrystalline phases, but also the microcrystalline phase, because the microcrystalline phase is more thermally stable than the amorphous and nanocrystalline phases and the microcrystalline phase can provide better hardness-elasticity than the nanocrystalline phase.

Thermally sprayed coatings having more than about 95 volume percent of amorphous phase have very good corrosion resistance but have less wear resistance because of the lack of hard nanocrystalline and microcrystalline phases. Thermally sprayed coatings having more than about 80 volume percent of nanocrystalline phase and about 90 volume percent of microcrystalline phase are hard but brittle (having decreased erosion resistance) because the coatings do not have a sufficient amount of more elastic amorphous based binder between the hard precipitants.

The overall thickness of the coating can vary depending on the end use application. The thermally sprayed coatings of this invention typically have a thickness of not greater than about 120 mils, preferably a thickness of not greater than about 90 mils, and more preferably a thickness of not greater than about 60 mils. In general, the coatings have a thickness of from about 4 mils to about 120 mils.

Illustrative thermally sprayed coatings of this invention include, for example, cermet, metal alloy and alloy-oxide ceramic coatings. Examples of suitable thermally sprayed coatings include tungsten carbide-cobalt, tungsten carbide nickel, tungsten carbide-cobalt chromium, tungsten carbide-nickel chromium, chromium-nickel, aluminum oxide, chromium carbide nickel chromium, chromium carbide-cobalt chromium, tungsten titanium carbide nickel, cobalt alloys, oxide dispersion in cobalt alloys, alumina-titania, copper based alloys, chromium based alloys, chromium oxide, chromium oxide plus aluminum oxide, titanium oxide, titanium plus aluminum oxide, iron based alloys, oxide dispersed in iron based-alloys, nickel, nickel based alloys, and the like. These unique coating materials are ideally suited for coating substrates made of materials such as titanium, steel, aluminum nickel, cobalt, alloys thereof and the like.

Illustrative cermet coatings can be represented by the formula WCM where M is Cr, Co, Ni, CrC, NiCr or any combination thereof. Preferred cermet coatings include, for example, WC—Co, WC—Co—Cr, WC—Ni, WC—Ni—Cr, WC/CrC—NiCr, and the like. See, for example, U.S. Pat. Nos. 4,999,255, 5,316,859, and 6,503,575.

Illustrative metal alloy coatings can be represented by the formula FeM'M" where M' is Cr, Ni, Co or any combination thereof; and M" is C, Si, B, P or any combination thereof. Preferred metal alloy coatings include, for example, FeCrPC, FeBC, FePC, FeCrNiPC, FeCrSiBC, and the like. See, for example, U.S. Pat. Nos. 3,986,867, 4,144,058 and 4,668,310.

Illustrative alloy-oxide ceramic coatings can be represented by the formula M'"CrAlY+X where M'" is Ni, Co or Fe or any combination thereof, and X is fine oxide ceramic dispersant particles, e.g., fine alumina dispersant particles. The alloy-oxide ceramic coatings may also include the addition of Pt, Ta, Hf, Re or other rare earth metals, singularly or in combination. Preferred alloy-oxide ceramic coatings include, for example, NiCrAlY—$Al_2O_3$, CoCrAlY—$Al_2O_3$, FeCrAlY—$Al_2O_3$, and the like. See, for example, U.S. Pat. No. 5,741,556.

Several combinations of amorphous, nanocrystalline and microcrystalline structures are possible in the thermally sprayed coatings of this invention. For example, with cermet coatings, CoNi or other metal-based solid solution matrix may have an amorphous and/or nanocrystalline structure and particles of carbides (e.g., WC, CrC and the like) may have a nanocrystalline and/or microcrystalline structure that are distributed in the metal-based matrix. The carbides may have a particle (i.e., a particle is made up of many grains) size greater than about 1 micron, but will have a grain size less than about 1 micron (1000 nanometers).

For metal alloy coatings, NiAl or other metal-based solid solution matrix may have an amorphous and/or nanocrystalline structure and particles of secondary phases (e.g., intermetallics, carbides, phosphates and the like) may have a nanocrystalline and/or microcrystalline structure that are periodically and/or homogeneously distributed in the metal-based matrix. The secondary phases may have a particle size greater than about 1 micron, but will have a grain size less than about 1 micron.

For alloy-oxide ceramic coatings, M'"CrAlY+X or other metal-based matrix may have a nanocrystalline and/or microcrystalline structure with inclusions of amorphous ceramic phase (e.g., $Al_2O_3$), and also ceramic inclusions having a nanocrystalline and/or microcrystalline structure that are periodically and/or homogeneously distributed in the metal-based matrix. The nanocrystalline and microcrystalline inclusions may have a particle size greater than about 1 micron, but will have a grain size less than about 1 micron.

As indicated above, this invention relates in part to a method of producing a thermally sprayed coating having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating; wherein said method comprises: (i) providing a thermal spray apparatus capable of generating a high velocity gas jet; (ii) providing a substrate to be impinged by said gas jet; (iii) generating said high velocity gas jet in which said thermal spray apparatus is operating at an equivalence ratio of from about 1 to about 3 and a firing frequency of from about 5 to about 200 Hz; and (iv) introducing into said gas jet a coating powder material not having an amorphous-nanocrystalline-microcrystalline composition structure; wherein said substrate is positioned at a distance from said thermal spray apparatus whereby said coating powder material impinges said substrate at a temperature and velocity effective to induce transformation of at least a portion of said coating powder material to said coating having an amorphous-nanocrystalline-microcrystalline composition structure.

As indicated above, this invention also relates in part to a thermal spray process comprising thermally depositing a coating powder material, said coating powder material not having an amorphous-nanocrystalline-microcrystalline composition structure, onto a substrate under thermal spray conditions sufficient to produce a coating having an amorphous-nanocrystalline-microcrystalline composition structure, said coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating.

This invention provides a method of producing a thermally sprayed coating having an amorphous-nanocrystalline-microcrystalline composition structure. The method includes providing a thermal spray apparatus capable of generating a high-velocity gas jet, providing a substrate to be impinged by the gas jet, generating the high-velocity gas jet and introducing into the gas jet a coating powder material not having an amorphous-nanocrystalline-microcrystalline composition structure. The substrate is positioned at a distance from the spray apparatus where the powder impinges the substrate at a temperature and velocity effective to induce transformation of at least a portion of the powder materials to an amorphous-nanocrystalline-microcrystalline structure. If desired, the velocity can be greater than said velocity effective to induce transformation of at least a portion of said powder to said amorphous-nanocrystalline-microcrystalline structure.

An advantage of the method of this invention is the ability to obtain a thermally sprayed coating having an amorphous-nanocrystalline-microcrystalline composition structure without the need to use a special amorphous-nanocrystalline-microcrystalline feedstock powder. The detonation method melts the powder particles during the spray process, and they rapidly solidify on the substrate to form the thermally sprayed coating having an amorphous-nanocrystalline-microcrystalline composition structure. The method of this invention is able to keep the solidification rate upon contact with the substrate above about $10^5$ K/s. Also, the method of this invention is able to deposit dense and thick (up to about 120 mils) coatings having an amorphous-nanocrystalline-microcrystalline composition structure from coating powder materials having a melting temperature above 1700° F.

The method of this invention preferably involves a detonation gun for cyclic spraying of the coating powder material to a coating thickness up to about 120 mils. The detonation gun is operated at an equivalence ratio of from about 1 to about 3 and a firing frequency of from about 5 to about 200 Hz, preferably from about 25 to about 175 Hz, and more preferably from about 50 to about 150 Hz. During one cycle of spraying, the powder is completely or partially molten because of the high temperature of the detonating gases and the subsequent solidification of the powder on contact with the substrate at a solidification rate upon contact with the substrate above about $10^5$ K/s. The molten phase transforms to nanocrystalline and/or amorphous solid structures. If the powder does not have a molten core, it can transform to a microcrystalline structure under the impulse of high pressure/deformation when the high velocity particle meets the substrate.

The next cycle applies a subsequent amorphous-nanocrystalline-microcrystalline coating layer which bonds metallurgically with the prior coating layer. The number of cycles can vary depending on the desired coating thickness. The thermally sprayed coating has a density similar to cast material (typically a porosity below about 0.5%), a bond strength with the substrate of greater than 10,000 psi, and an amorphous-nanocrystalline-microcrystalline structure throughout the bulk volume of the coating.

Illustrative thermal spray powders useful in this invention include any powders that, when sprayed, give thermally sprayed coatings having an amorphous-nanocrystalline-microcrystalline composition structure. The thermal spray powders useful in this invention do not have an amorphous-nanocrystalline-microcrystalline composition structure. The thermal spray powder, not having an amorphous-nanocrystalline-microcrystalline composition structure, is introduced into a gas jet of a thermal spray apparatus, and a substrate is positioned at a distance from the thermal spray apparatus. The concentration of the coating powder material should be an effective amount that impinges the substrate at a temperature and velocity effective to induce transformation of at least a portion of the coating powder material to a coating having an amorphous-nanocrystalline-microcrystalline composition structure. The phases of the thermal spray coatings of this invention can result from phase transformation inside the powder particles during the coating deposition.

The average particle size of the thermal spraying powders useful in this invention is preferably set according to the type of thermal spray device and thermal spraying conditions used during thermal spraying. The average particle size can range from about 1 to about 150 microns, preferably from about 5 to about 50 microns, and more preferably from about 10 to about 45 microns. Any powder suitable for use in a conventional thermal spray process and having a particle size below −270 mesh can be used to spray the bulk amorphous-nanocrystalline-microcrystalline coatings of this invention.

The thermal spraying powders useful in this invention can be produced by conventional methods such as agglomeration (spray dry and sinter or sinter and crush methods) or cast and crush. In a spray dry and sinter method, a slurry is first prepared by mixing a plurality of raw material powders and a suitable dispersion medium. This slurry is then granulated by spray drying, and a coherent powder particle is then formed by sintering the granulated powder. The thermal spraying powder is then obtained by sieving and classifying (if agglomerates are too large, they can be reduced in size by crushing). The sintering temperature during sintering of the granulated powder is preferably 1000 to 1300° C.

The thermal spraying powders useful in this invention may be produced by another agglomeration technique, sinter and crush method. In the sinter and crush method, a compact is first formed by mixing a plurality of raw material powders followed by compression and then sintered at a temperature between 1200 to 1400° C. The thermal spraying powder is then obtained by crushing and classifying the resulting sintered compact into the appropriate particle size distribution.

The thermal spraying powders useful in this invention may also be produced by a cast (melt) and crush method instead of agglomeration. In the melt and crush method, an ingot is first formed by mixing a plurality of raw material powders followed by rapid heating, casting and then cooling. The thermal spraying powder is then obtained by crushing and classifying the resulting ingot.

In general, the thermal spraying powders can be produced by conventional processes such as the following:

Spray Dry and Sinter method—the raw material powders are mixed into a slurry and then spray granulated. The agglomerated powder is then sintered at a high temperature (at least 1000° C.) and sieved to a suitable particle size distribution for spraying;

Sinter and Crush method—the raw material powders are sintered at a high temperature in a hydrogen gas or inert atmosphere (having a low partial pressure of oxygen) and then mechanically crushed and sieved to a suitable particle size distribution for spraying;

Cast and Crush method—the raw material powders are fused in a crucible and then the resulting casting is mechanically crushed and sieved; and Densification method—the powder produced in any one of above process (i)-(iii) is heated by plasma flame or laser and sieved (plasma-densifying or laser-densifying process).

The average particle size of each raw material powder is preferably no less than 0.1 microns and more preferably no less than 0.2 microns, but preferably no more than 10 microns. If the average particle size of a raw material powder is too small, costs may increase. If the average particle size of a raw material powder is too large, it may become difficult to uniformly disperse the raw material powder.

The individual particles that compose the thermal spraying powder preferably have enough mechanical strength to stay coherent during the thermal spraying process. If the mechanical strength is too small, the powder particle may break apart clogging the nozzle or accumulate on the inside walls of the thermal spray device.

The coating process involves flowing powder through a thermal spraying device that heats and accelerates the powder onto a substrate. Upon impact, the heated particle deforms resulting in a thermal sprayed lamella or splat. Overlapping splats make up the coating structure. A detonation process useful in this invention is disclosed in U.S. Pat. No. 2,714,563, the disclosure of which is incorporated herein by reference. The detonation process is further disclosed in U.S. Pat. Nos. 4,519,840 and 4,626,476, the disclosures of which are incorporated herein by reference. U.S. Pat. No. 6,503,290, the disclosure of which is incorporated herein by reference, discloses a high velocity oxygen fuel process useful in this invention.

The substrates to be coated with the thermal spray coatings of this invention are materials with metal thermal conductivity. Examples of materials to be coated include, but are not limited to, steel, Ni-, Co-, Ti-based alloys, graphite, aluminum, copper, and the like. Likewise, the substrate can be in any shape or form that is capable of being coated with the thermal spray coating.

The thermally sprayed coatings of this invention can be applied by a conventional thermal spray apparatus or device. The thermal spray apparatus or device is preferably capable of generating a high velocity gas jet and operating at an equivalence ratio of from about 1 to about 3 and a firing frequency of from about 5 to about 200 Hz. Illustrative thermal spray devices include, for example, a detonation gun and a high velocity oxy-fuel torch or gun.

An equivalence ratio higher than about 3 will result in carbon (soot) contamination leading to poor coating quality. An equivalence ratio less than about 1 will result in higher than 0.2% oxygen concentration in the coating (in the form of oxides) that will make the coating brittle. The thermally sprayed coatings deposited with a firing frequency less than about 5 Hz will have a high level of residual stresses that result in poor mechanical properties. A firing frequency above about 200 Hz is technically challenging and may not be used to deposit coatings by detonation spray methods.

The high velocity gas jet is generated using any known apparatus for thermal spray techniques. As will be apparent those skilled in the art, the thermal spray apparatus must be capable of generating a gas jet having a velocity sufficient to reach the effective particle velocity for phase transformation to occur, e.g., a velocity of greater than about 600 meters/second. However, reaching an effective velocity to induce phase transformation is dependent on both the velocity of the gas jet and the distance between the thermal spray apparatus and the substrate. One can therefore adjust the distance between spray apparatus and the substrate to provide the particulate with an effective velocity to induce transformation upon impact with the substrate. In addition, as will be apparent to those skilled in the art, other process parameters or conditions can be adjusted to alter particle velocity.

Preferably, velocities in excess of the required effective velocities are used to increase microcrystalline content of the coating. Particle velocities in excess of the effective velocity for transformation may provide greater yields of the microcrystalline phase.

The thermal spray apparatus should be capable of generating a gas jet having a temperature sufficient to at least partially melt the powder particles to provide sufficient amount of liquid phase for its transformation to amorphous and nano-phase at the contact with substrate surface by mechanism of rapid solidification (with cooling velocity $10^5$ K/s or above). The liquid phase also increases adhesion of the propelled particulate to the substrate. As will be apparent to those skilled in the art, the required temperature needed to melt the particulate will vary with the choice of the powder material.

In those situations in which the thermal spray apparatus is a detonation gun, the thermal content of the gas stream in the gun, as well as the velocity of the gas stream, can be varied by changing the composition of the gas mixtures. Both the fuel gas composition and the ratio of fuel to oxidant can be varied. The oxidant is usually oxygen. In the case of detonation gun deposition, the fuel is usually acetylene. In the case of high frequency pulse detonation (HFPD) gun deposition, the fuel is usually propane, propylene or their mixtures with another fuel such as methane. In the case of Super D-Gun deposition, the fuel is usually a mixture of acetylene and another fuel such as propylene. The thermal content can be reduced by adding a neutral gas such as nitrogen.

In those situations in which the thermal spray device is a high velocity oxy-fuel (HVOF) torch or gun, the thermal content and velocity of the gas stream from the torch or gun can be varied by changing the composition of the fuel and the oxidant. The fuel may be a gas or liquid. The oxidant is usually oxygen gas, but may be air or another oxidant.

Variations in gas stream velocity from the thermal spray device can result in variations in particle velocities and hence dwell time of the particle in flight. This affects the time the particle can be heated and accelerated and, hence, its maximum temperature and velocity. Dwell time is also affected by the distance the particle travels between the torch or gun and the surface to be coated.

The specific deposition parameters used with any of the thermal spray devices depend on both the characteristics of the device and the materials being deposited. The rate of change or the length of time the parameters are held constant are a function of the required coating thickness, the rate of traverse of the gun or torch relative to the surface being coated, and the size of the article or part being coated.

The thermally sprayed coatings of this invention are preferably applied by a detonation spray method. Detonation spray is performed with spray guns that basically consist of a tubular explosion chamber with one end closed and the other open, to which a barrel, also tubular, is connected. The explosive gases are injected inside the explosion chamber and ignition of the gas mixture is produced by means of a spark plug, which provokes an explosion and in consequence, a shock or pressure wave that reaches supersonic speeds during its propagation inside the barrel until it leaves the open end.

The coating material powders are usually injected inside the barrel in contact with the explosive mixture so that they are dragged along by the propagating shock wave and by the set of gaseous products from the explosion, which are expulsed at the end of the barrel, and deposited on a substrate or part that has been placed in front of the barrel. This impact of the coating powders on the substrate produces a high density coating with elevated levels of internal cohesion and adherence to the substrate. This process is repeated in a cyclic manner until the part is suitably coated.

A preferred detonation spray method comprises using a detonation gun with a high firing rate frequency, e.g., a HFPD gun. See, for example, U.S. Pat. Nos. 6,745,951, 6,168,828, 6,146,693, 6,000,627, 5,985,373, 6,212,988, 6,517,010, and 6,398,124, the disclosures of which are incorporated herein by reference.

The HFPD gun allows working at higher frequencies than those employed in other detonation devices with a large volume of powder feeding, achieving greater deposit rates, even when compared with those obtained with current HVOF continuous combustion equipment, but maintaining the higher thermodynamic efficiency of the explosive processes in the use of the gases and precursors, resulting in greater productivity.

The HFPD spray system is based on the generation of explosive gaseous mixtures of different compositions in different zones of a chamber zone, which is due to a specific design of the gas injectors and the explosion chamber, employing dynamic valves and direct, separate injection for fuel and oxidizer, without pre-mixing of both prior to the explosion chamber itself.

The HFPD spray system is a very productive method of coating deposition. It allows the production of coatings at deposition rates 2-8 times higher and at deposition efficiencies up to 200% higher than conventional thermal spray processes. The HFPD spray system is a unique technique for producing thermally sprayed coatings having an amorphous-nanocrystalline-microcrystalline composition structure that exhibit enhanced wear and corrosion resistance. HFPD spray systems can save significant material, labor and time resources and increase durability and reliability of the coated part or article.

Increasing parts longevity is an important challenge that many industries are facing. Critical component failures due to premature wear and corrosion can lead to significant losses. Metallurgy, paper, printing, oil field and other industries require high performance coatings that will bring cost reductions and improvements in productivity. The HFPD spray method can reduce powder and process gases consumption and can also reduce labor costs because of higher deposition rates.

Another preferred detonation spray method comprises using a detonation gun with a detonatable fuel mixture comprising (a) an oxidant and (b) a fuel mixture of at least two combustible gases selected from saturated and unsaturated hydrocarbons and wherein the combustion temperature of the fuel mixture is lower than the combustion temperature of one of the combustible gases, e.g., a Super D-Gun. See, for example, U.S. Pat. No. 4,902,539, the disclosure of which is incorporated herein by reference.

Illustrative oxidants comprise oxygen, nitrous oxide or mixtures thereof. Illustrative fuel mixtures comprise a mixture of acetylene and a second combustible gas selected from propylene, methane, ethylene, methyl acetylene, propane, pentane, a butadiene, a butalene, a butane, ethylene oxide, ethane, cyclopropane, propadiene, cyclobutane or mixtures thereof. The preferred fuel mixture comprises acetylene and propylene. The preferred detonatable fuel mixture comprises oxygen, acetylene and propylene.

In an embodiment, the detonatable fuel mixture comprises from about 35 to about 80 percent by volume oxygen, from about 2 to about 50 percent by volume acetylene, and from about 2 to about 60 percent by volume of a second combustible gaseous fuel, e.g., propylene. Preferably, the detonatable fuel mixture comprises from about 45 to about 70 percent by volume oxygen, from about 7 to about 45 percent by volume acetylene, and from about 10 to about 45 percent by volume of a second combustible fuel, e.g., propylene. More preferably, the detonatable fuel mixture comprises from about 50 to about 65 percent by volume oxygen, from about 12 to about 26 percent by volume acetylene, and from about 18 to about 30 percent by volume of a second combustible gaseous fuel such as propylene. In some applications, it may be desirable to add an inert diluent gas to the gaseous fuel oxidant mixture. Suitable inert diluting gases include, for example, argon, neon, krypton, xenon, helium and nitrogen.

This invention also provides a coated article, which is prepared by coating a substrate, as described above, with a thermally sprayed coating in which the thermally sprayed coating has an amorphous-nanocrystalline-microcrystalline composition structure, produced in accordance with this invention. The article can have successive layers of different thermal spray coatings. Thus, following the teachings of the invention, a variety of coated articles can be made.

As indicated above, this invention relates in part to an article coated with a thermally sprayed coating, said thermally sprayed coating having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating.

The thermally sprayed coatings of this invention having an amorphous-nanocrystalline-microcrystalline composition structure provide enhanced wear and corrosion resistance for articles used in severe environments such as for landing gears, airframes, ball valves, gate valves (gates and seats), pot rolls, work rolls for paper processing, and the like.

While the preferred embodiments of this invention have been described, it will be appreciated that various modifications may be made to the thermally sprayed coatings having an amorphous-nanocrystalline-microcrystalline composition structure, methods of producing the thermally sprayed coatings, processes for producing the thermally sprayed coatings on substrates, and articles coated with the thermally sprayed coatings, without departing from the spirit or scope of the invention.

Example 1

Coatings from WC—Co-based compositions were prepared in the following manner. The coatings were sprayed to a thickness of 120 mils with a commercially available powder (−325 mesh) through a detonation gun with firing frequency 75 Hz and equivalence ratio 1.85. The hot gases (products of detonation) were melting the powder during transportation of the powder to the substrate. Upon impact, the droplets spread and rapidly solidified. When the next monolayer was depositing, the previously solidified the solid layer was subjected to heat and deformation from the powder-gas stream.

The coatings were characterized by x-ray diffraction (XRD), transmission electron microscopy (TEM), optical microscopy, scan electron microscopy (SEM), differential thermal analysis (DTA), polarization corrosion resistance test, and sand abrasion and sand erosion tests provided in accordance with ASTM standards.

The typical XRD pattern representing amorphous matrix reinforced with bimodal nanocrystalline-microcrystalline precipitants is shown in FIG. 1. The pattern contains three types of peaks. It has a very broad maximum having broadening around 10 2θ degree representing the amorphous phase (A) and has several peaks from crystalline carbide and metal based solid solution. The nanocrystalline-solid solution (N) has maximums just slightly narrower than amorphous peak, the carbide phase is represented of more narrow maximums because the presence of microcrystalline carbides. The grain size coating phases was determined by Scherrer equation:

$$D=K\lambda/b\cos\theta$$

where:

D—the grain size;

K—a constant about equal to 1.0;

λ—wavelength of X-ray radiation;

b—X-ray diffraction maximum broadening;

—characteristic diffraction angle.

The coating phase grain size determined by this classical XRD method was: the metal solid solution—50-100 nm, carbides—80-800 nm (the microcrystalline dimensions are dimensions below 1 μm (1000 nm)).

The presence of amorphous and nanocrystalline phases was also identified by transmission electron microscopy (TEM) which is a direct method to see and identify nanocrystalline and amorphous phases. The typical images taken from the coating are shown in FIG. 2. The TEM electron diffractions also revealed the presence not only nanocrystalline-solid solution and carbides, but also nano crystalline-oxides.

Figure 3:
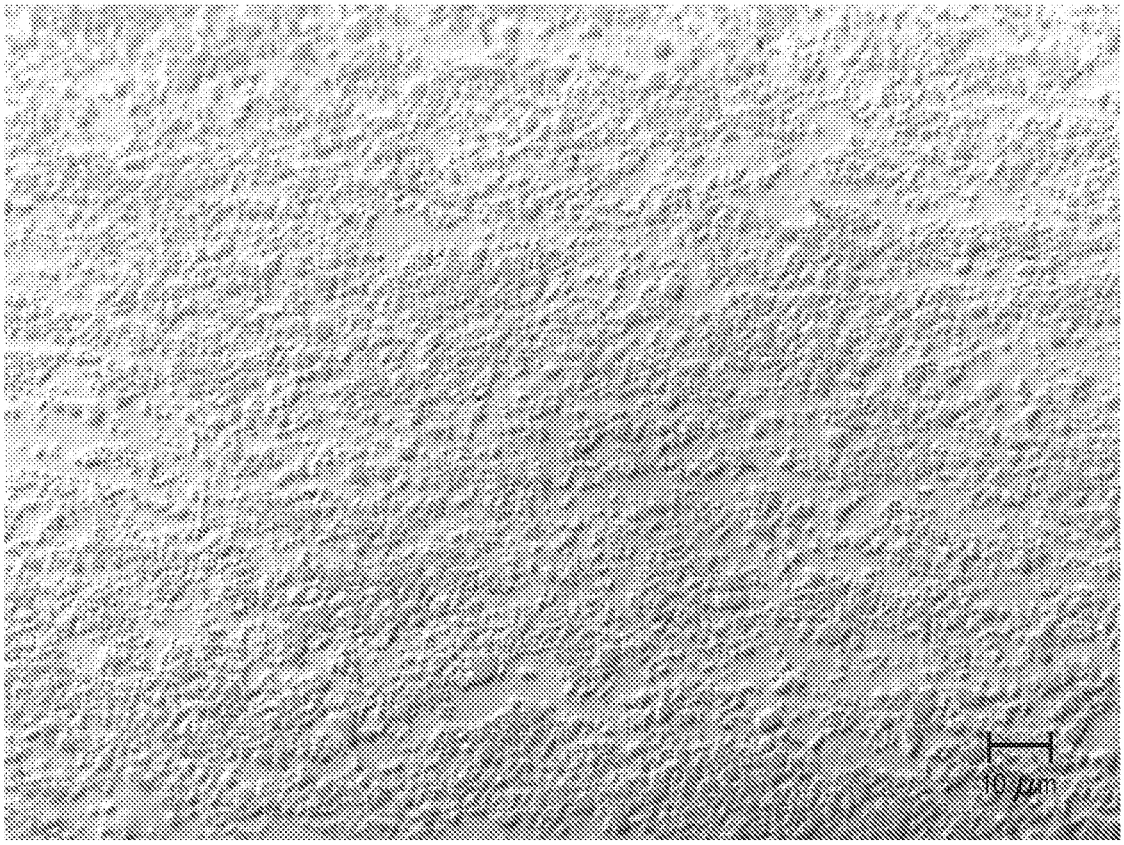
FIG. 3 is an optical microstructure of a WC—Co-based high frequency pulse detonation coating, 1000×.

The coating optical microstructure is shown in FIG. 3. It can be seen that the carbide particle size can exceed 1 μm, but all of them have polycrystalline structure with grain size less than 1 μm—microcrystalline and/or nanocrystalline grains, as proven by XRD and TEM methods. The distance between carbide particles does not exceed 0.5 mils (see FIG. 3).

Figure 4:
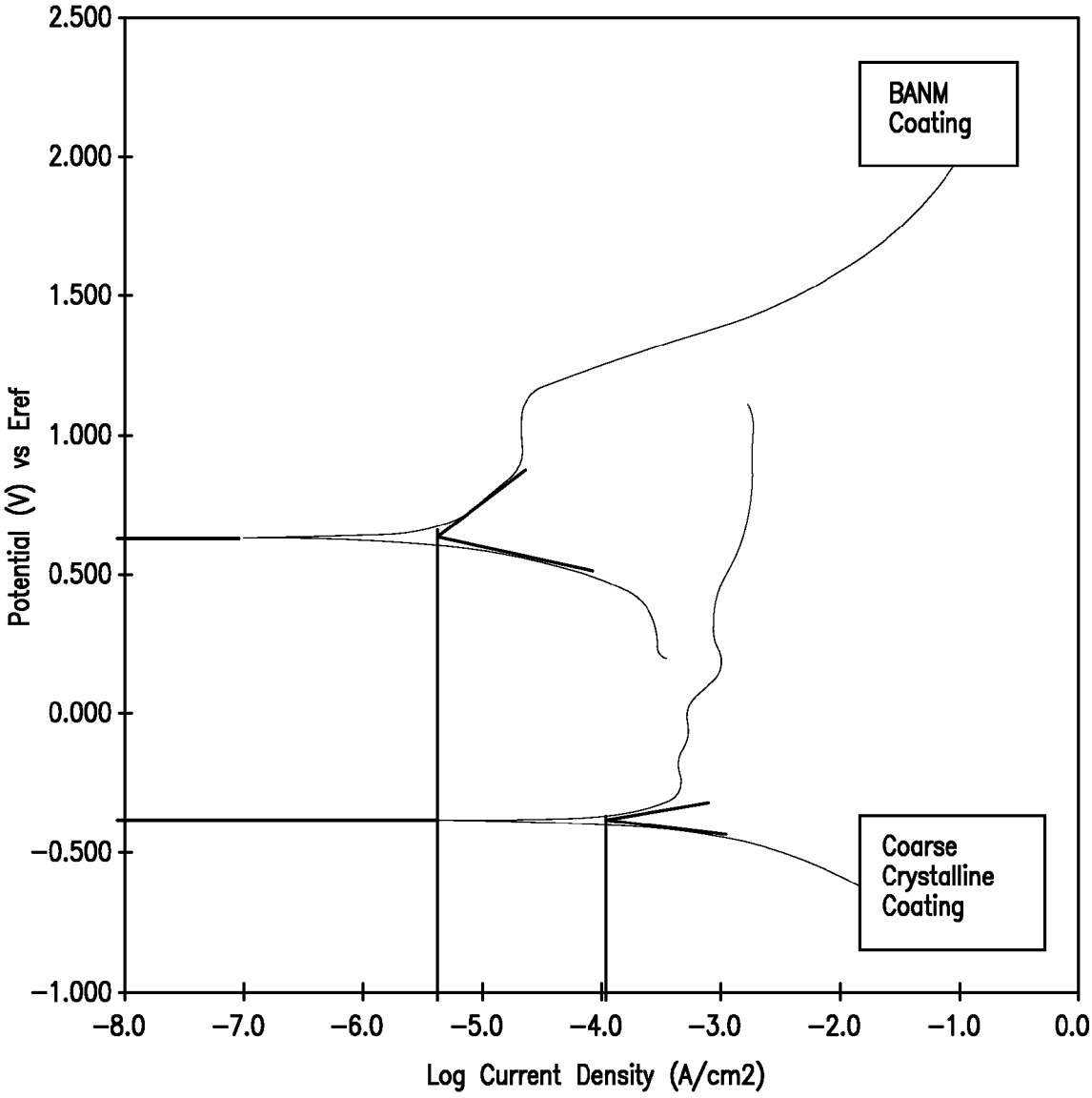
FIG. 4 depicts polarization curves of detonation bulk amorphous-nanocrystalline-microcrystalline WC—Co-based coating and coarse crystalline thermal spray coating from the same composition. The corrosion resistance of the coatings was tested in 1N sulfuric acid (ASTM G 59). The bulk amorphous-nanocrystalline-microcrystalline coating showed significantly lower corrosion current density and had more positive corrosion potential than the conventional coarse crystalline coating.

The polarization curves for WC—Co-alloy coating with and without nanocrystalline-amorphous component are shown in FIG. 4. Materials with higher corrosion resistance have more positive corrosion potential ($V_{corr.}$) and smaller number of corrosion current density logarithm (log $I_{corr.}$). The standard test (ASTM G 59) showed that the coating with amorphous-nanocrystalline-microcrystalline structure has significantly higher corrosion resistance than the conventional structure coating. The bulk amorphous-nanocrystalline-microcrystalline coating had $V_{corr}$=0.6 V, and log $I_{corr}$=−0.54 A/cm$^2$ ($i_{corr.}$=0.004 ma/cm$^2$), the conventional structure coating has $V_{corr}$=−0.4 V, and log $I_{corr.}$=−0.39 A/cm$^2$ ($i_{corr.}$=0.1 mA/cm$^2$), which means the coating of this invention has about 25 times higher corrosion resistance than the conventional one.

The abrasion and erosion test (ASTM G-65 and G-76) data are summarized in Table 1. It can be seen that the bulk amorphous-nanocrystalline-microcrystalline (BANM) coatings of this invention have wear resistance 2.5-3 times higher than the conventional thermal spray coating, and that bulk amorphous-nanocrystalline-microcrystalline coatings are almost free from residual stresses.

The enhanced mechanical properties are the result of periodical (distance less than 0.5 mils) distribution of bimodal (nanocrystalline-microcrystalline) hardening phase in relatively hard but ductile metal amorphous matrix.

TABLE 1

Wear Resistance and Residual Stresses Results

| Coating | BANM WC—Co alloy coating 1 | BANM WC—Co alloy coating 2 | Conventional WC—Co alloy coating |
|---|---|---|---|
| Sand abrasion, mm$^3$/1000 revolutions | 1.75 | 1.15 | 5.3 |
| Sand erosion, 30°, μ/g | 17.9 | 21 | 30.7 |
| Sand erosion, 90°, μ/g | 66.2 | 82 | 188 |
| Stresses (Almen intensity, mils) | 0 | −0.5 | +4.5 |

Example 2

The Fe(balance)-Cr—P—C composition is a composition which in amorphous condition has extremely high corrosion resistance, but this composition has high critical solidification rate (above $10^5$ K/s) to obtain an amorphous structure from liquid phase. The rate can be achieved by conventional rapid solidification methods only in foil/ribbon thinner than 2 mils. That did not allowed use of this material for the practical purposes.

The detonation method described in Example 1 was used to deposit a bulk amorphous coating with nanocrystalline-microcrystalline strengthening phases as thick as 120 mils. The coating contained about 90% of nanocrystalline-amorphous phase, and about 10% of microcrystalline phase. The coating XRD pattern confirmed the amorphous structure.

Figure 5:
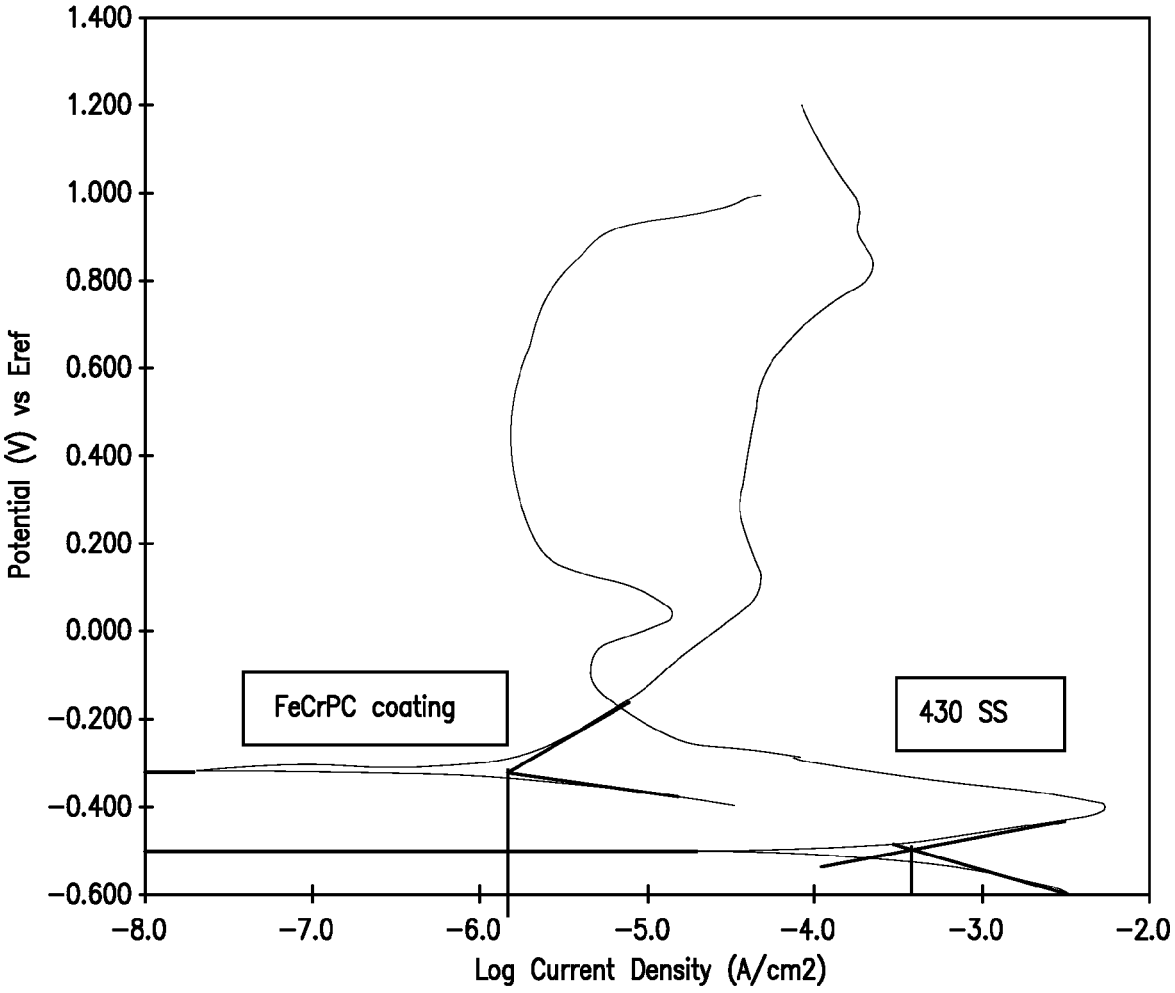
FIG. 5 depicts polarization curves of detonation bulk amorphous-nanocrystalline-microcrystalline FeCrPC coating and 430 stainless steel. The coating and steel corrosion resistance was tested in 1N sulfuric acid (ASTM G 59). The coating has significantly less corrosion current density, and has more positive corrosion potential than the stainless steel. Lower corrosion current and more positive corrosion potential mean higher corrosion resistance.

The bulk amorphous-nanocrystalline-microcrystalline coatings from Fe-based alloy had corrosion resistance significantly higher (more than 10 times) than stainless steel (FIG. 5). The bulk amorphous-nanocrystalline-microcrystalline coatings from Fe-based alloy had higher hardness than conventional 100% amorphous about 1.5 mils thick ribbon. The hardness of bulk amorphous-nanocrystalline-microcrystalline coating from Fe-based alloy was equal to about 850 $HV_{.200}$. The amorphous ribbon had a hardness equal to about 750 $HV_{.200}$.

The study of thermal stability of the FeCrPC bulk amorphous-nanocrystalline-microcrystalline coatings in comparison with conventional amorphous ribbon from the same alloy have shown that the bulk amorphous-nanocrystalline-microcrystalline coating has significantly higher thermal stability. After isothermal annealing, the bulk amorphous-nanocrystalline-microcrystalline coatings had kept the fine structure and high hardness (about 10000-11000 HV) up to about 1400° F., but the ribbon lost them at about 1100° F. The coating had higher thermal stability because the microcrystalline carbides and microcrystalline-nanocrystalline-scale oxides periodically distributed in the metal matrix work as barriers for metal grain growing.

Example 3

A coating sprayed with the detonation method described in Example 1 from MCrAlY+$Al_2O_3$ (20-50%) composition exhibited bulk amorphous-nanocrystalline-microcrystalline structure with about 80% of microcrystalline metal phase, about 10% of amorphous (ceramic) phase, and about 10% of nanocrystalline-phase.

The invention claimed is:

1. A thermally sprayed coating having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating, in which (i) the nanocrystalline phase comprises discrete particles, wherein said particles comprise one or more grains having a nanocrystalline structure, and wherein said nanocrystalline structure comprises a grain size of less than about 100 nanometers; and (ii) the microcrystalline phase comprises discrete particles, wherein said particles comprise one or more grains having a microcrystalline structure, and wherein said microcrystalline structure comprises a grain size of from about 100 nanometers to less than about 1000 nanometers, wherein the distance between said nanocrystalline phase particles is no greater than about 0.5 mils, the distance between said microcrystalline phase particles is no greater than about 0.5 mils, and the distance between said nanocrystalline phase particles and said microcrystalline phase particles is no greater than about 0.5 mils.

2. A thermally sprayed coating having an amorphous-nanocrystalline-microcrystalline composition structure, said thermally sprayed coating comprising from about 5 to about 90 volume percent of said amorphous phase, from about 5 to about 75 volume percent of said nanocrystalline phase, and from about 5 to about 80 volume percent of said microcrystalline phase, wherein said amorphous phase, nanocrystalline phase and microcrystalline phase comprise about 100 volume percent of said thermally sprayed coating.

3. The thermally sprayed coating of claim 2 which has a thickness of not greater than about 120 mils.

4. An article coated with the thermally sprayed coating of claim 2.

5. The article of claim 4 which is coated by a frequency pulse detonation gun.

6. The article of claim 5 wherein the detonation gun operates at an equivalence ratio of from about 1 to about 3 and a firing frequency of from about 5 to about 200 Hz.

7. The article of claim 4 which is a material selected from the group consisting of steel, Ni-, Co-, Ti-based alloys, graphite, aluminum, copper.

8. The article of claim 4 selected from the group consisting of landing gears, airframes, ball valves, gate valves, pot rolls, and work rolls for paper processing.

9. A thermally sprayed coating having an amorphous-nanocrystalline-microcrystalline composition structure, said thermally sprayed coating comprising from about 1 to about 95 volume percent of an amorphous phase, from about 1 to about 80 volume percent of a nanocrystalline phase, and from about 1 to about 90 volume percent of a microcrystalline phase, and wherein said amorphous phase, nanocrystalline phase and microcrystalline phase comprise about 100 volume percent of said thermally sprayed coating, wherein the coating comprises a cermet, metal alloy or alloy-oxide ceramic coating, in which the cermet coating comprises WCM where M is Cr, Co, Ni, CrC, NiCr or any combination thereof, the metal alloy coating comprises FeM'M" where M' is Cr, Ni, Co or any combination thereof, and M" is C, Si, B, P or any combination thereof, and the alloy-oxide ceramic coating comprises M'"CrAlY+X where M'" is Ni, Co or Fe or any combination thereof, and X is fine oxide ceramic dispersant particles, in which the fine oxide ceramic dispersant particles comprise fine alumina dispersant particles, and said alloy-oxide ceramic coating optionally includes the addition of Pt, Ta, Hf, Re, singularly or in combination.

* * * * *